US006913312B2

(12) United States Patent
Clary et al.

(10) Patent No.: US 6,913,312 B2
(45) Date of Patent: Jul. 5, 2005

(54) ARTICULATING CHAIR

(76) Inventors: Michael Clary, 14003 Fox Run Ct., Phoenix, MD (US) 21131; Donald Deuterman, 5436 Cynthia Dr., Baltimore, MD (US) 21206

( * ) Notice: Subject to any disclaimer, the term of this patent is extended or adjusted under 35 U.S.C. 154(b) by 361 days.

(21) Appl. No.: 09/765,098

(22) Filed: Jan. 18, 2001

(65) Prior Publication Data

US 2002/0027381 A1 Mar. 7, 2002

Related U.S. Application Data

(60) Provisional application No. 60/176,572, filed on Jan. 18, 2000.

(51) Int. Cl.[7] ..... A47C 13/00

(52) U.S. Cl. ..... 297/118; 5/633; 297/440.11; 297/440.21; 297/452.13

(58) Field of Search ..... 297/118, 219.1, 297/229, 440.11, 440.24; 5/633, 111; 135/114, 127, 139; 52/726.1; 403/294, 305, 347

(56) References Cited

U.S. PATENT DOCUMENTS 1,865,030 A * 6/1932 McCauley ..... 297/229
2,429,795 A * 10/1947 Blanchard et al. ..... 297/118
3,092,224 A * 6/1963 O'Neil ..... 297/118
3,565,419 A * 2/1971 Allard et al. ..... 5/633 X
4,208,070 A 6/1980 Geschwender
4,410,214 A 10/1983 Geschwender
4,470,630 A * 9/1984 Shields ..... 297/118
4,557,409 A * 12/1985 Hecock et al. ..... 227/147
4,657,302 A * 4/1987 Snyder ..... 297/232
4,918,896 A * 4/1990 Wiese ..... 52/632
4,997,165 A * 3/1991 Wiese ..... 256/59
5,347,881 A * 9/1994 Watson et al. ..... 403/305 X
5,435,203 A * 7/1995 Spease et al. ..... 74/502.6
5,749,179 A * 5/1998 Bohacik ..... 52/127.2
5,927,894 A * 7/1999 Zavaglia ..... 403/305 X

* cited by examiner

*Primary Examiner*—Rodney B. White
*Assistant Examiner*—Stephen Vu
(74) *Attorney, Agent, or Firm*—Law Offices of Royal W. Craig

(57) ABSTRACT

An articulating knock-down frame and an improved cover design for a chair. The frame includes a pair of separate generally U-shaped frame portions, one being a seat and the other a backrest, and a pair of generally L-shaped connectors adapted for a telescopic fit with the U-shaped portions. The U-shaped frame portions are champfered about their ends to ease installation of the cover and to prevent tearing. An optional feature is also shown to facilitate disassembly, and this is a spring-loaded break joint in one or both of the U-shaped frame portions. The cover fits over the frame and holds the component parts in assembly. The cover includes a top panel section sewn against a bottom panel section, and a side panel section sewn therebetween to form an enclosure for holding an integral cushion.

4 Claims, 8 Drawing Sheets

ARTICULATING CHAIR

CROSS-REFERENCE TO RELATED APPLICATIONS

The present application is based on U.S. provisional application Ser. No. 60/176,572 filed on Jan. 18, 2000 by Michael Clary and Donald Deuterman for their "ARTICULATING CHAIR".

BACKGROUND OF THE INVENTION

1. Field of the Invention

The present invention relates to an articulating chair and, more particularly, to an improved fabric cover and refined knock-down frame which are quickly assembled to form a two-position chair.

2. Description of the Background

Articulating knock-down chairs are fairly well-known in the art. For example, U.S. Pat. No. 4,208,070 to Geschwender discloses a leg-less leisure chair with a generally L-shaped one-piece rectangular frame, and a cushion swingable relative to the frame. The chair may be used in two different positions on the floor, one in which the cover functions as a backrest and the cushion as a seat, and the other in which the cover presents a reclining surface and the cushion provides a headrest to one reclining on the surface.

As shown in FIGS. 1 and 2 (prior art), U.S. Pat. No. 4,410,214 to Geschwender improves the above-described frame, suggesting a collapsing four-piece frame including a pair of long U-shaped frame portions and a pair of short L-shaped connectors adapted for a telescopic fit in the ends of the U-shaped frame portions. In addition to a fully-functional articulating four-piece frame design, the '214 patent also teaches a basic cover for holding the frame together. The removable cover 11 fits over the frame and is preferably formed to hold the component parts 5, 7 and 9 of the frame in assembly. Cover 11 is tubular in shape, and may be fabricated of corduroy, canvas or plastic. The cover 11 includes a pocket 27 for holding a cushion that is swingable relative to the frame. This pocket 27 comprises a pair of rectangular extensions, each designated 29, extending in face-to-face relation outwardly (to the right) from the adjoining ends of sections 21, 23 and connected at their sides and at their outer ends by an elongate piece 31 of material. The frame cover 11 is closed at one end and open at the other end allowing it to be slipped on and off the frame, and it has an integral end portion or flap 37 at its open end for covering the outer end of the frame.

Though the above-described leisure chairs have been well-received, the covers have proven difficult and costly to manufacture, and time-consuming to install. Moreover, previous patterns and fabrics have been susceptible to wear and tear, shortening the useful life of the chair. It would be greatly advantageous to provide a simple, more rugged cover for an articulating leisure chair, and to refine the collapsing frame to thereby reduce the cost, simplify assembly, and increase the useful life of the chair.

SUMMARY OF THE INVENTION

It is, therefore, an object of the present invention to provide an improved frame for an articulating leisure chair, and a pattern for a custom fitted cover that is particularly configured to safely and securely hold the articulating frame in assembly.

It is another object to provide a more rugged and durable cover that can be installed on the frame with confidence that it will not come loose.

It is still another object to refine the construction and materials of the collapsing frame to help simplify assembly, and increase the useful life of the cover.

It is still another object to add one or more spring-loaded break-points to the frame to allow it to be knocked-down without separation of the component parts.

According to the present invention, the above-described and other objects are accomplished by providing an articulating chair having a knockdown frame including a pair of separate generally U-shaped frame portions. One of the frame portions constitutes a seat and the other constitutes a backrest. The frame also includes a pair of generally L-shaped connectors adapted for a telescopic fit with the ends of the U-shaped portions to form a rigid generally L-shaped frame. A unique removable cover is also provided to fit over the frame and to hold the component parts in assembly. The cover includes a top panel section sewn against a bottom panel section, a side panel section sewn there between to form an enclosure for holding a cushion there between. The cover is insertable over the frame and is pivotable relative to the frame. This way, the chair may be assembled and positioned on a surface in one of two positions, including a first position in which the seat portion of the frame rests flat with the backrest portion extending upward and the cushion extends forwardly from the frame to provide a seat, and a second position in which in which the seat portion of the frame extends upwardly and the backrest portion slopes downwardly with the cushion resting thereon to present a reclining surface. The U-shaped frame portions are chamfered about their ends to ease installation of the cover and to prevent tearing. In addition to the chamfer, the frame sections are zinc plated to form a continuous coating, the result being a lubricating protective film that further eases installation of the cover and prevents tearing.

An optional feature is also shown to facilitate disassembly, and this is a spring-loaded break joint in one or both of the U-shaped frame portions.

BRIEF DESCRIPTION OF THE DRAWINGS

Other objects, features, and advantages of the present invention will become more apparent from the following detailed description of the preferred embodiment and certain modifications thereof when taken together with the accompanying drawings in which.

DETAILED DESCRIPTION OF THE PREFERRED EMBODIMENTS

The present invention provides a two-position chair comprising an improved fabric cover 2 and a refined knock-down frame 4 which are easier to manufacture and to assemble.

Figure 1:
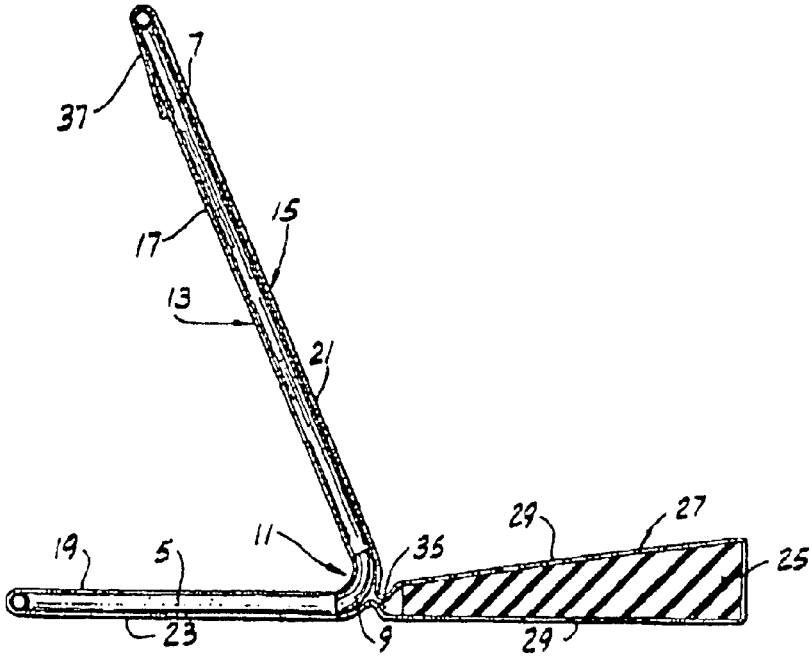
FIG. 1 (Prior Art)
FIGS. 1 and 2 are a side drawing and a side perspective drawing, respectively, of the prior art leisure chair set forth in U.S. Pat. No. 4,410,214 to Geschwender.
Figure 2:
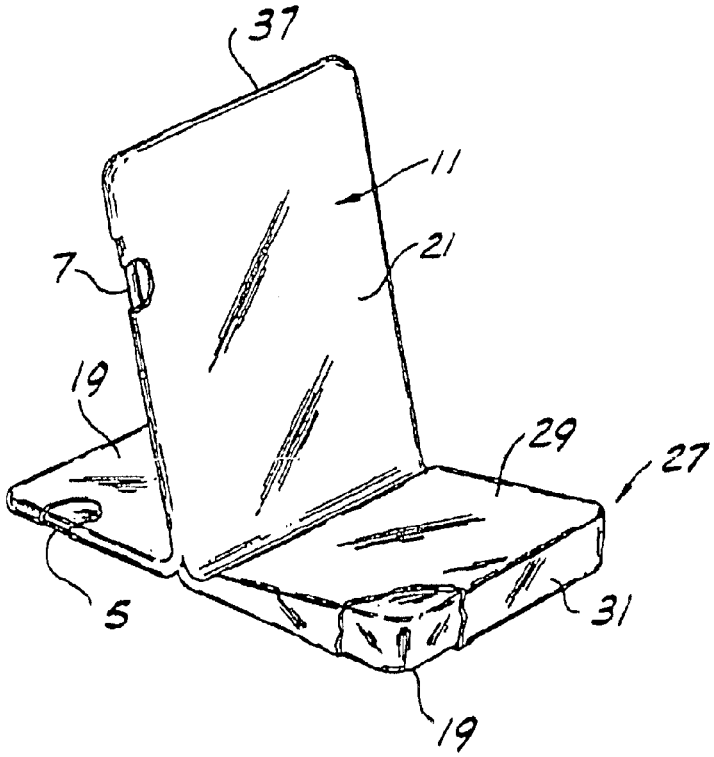
FIG. 2 (Prior Art)
Figure 4:
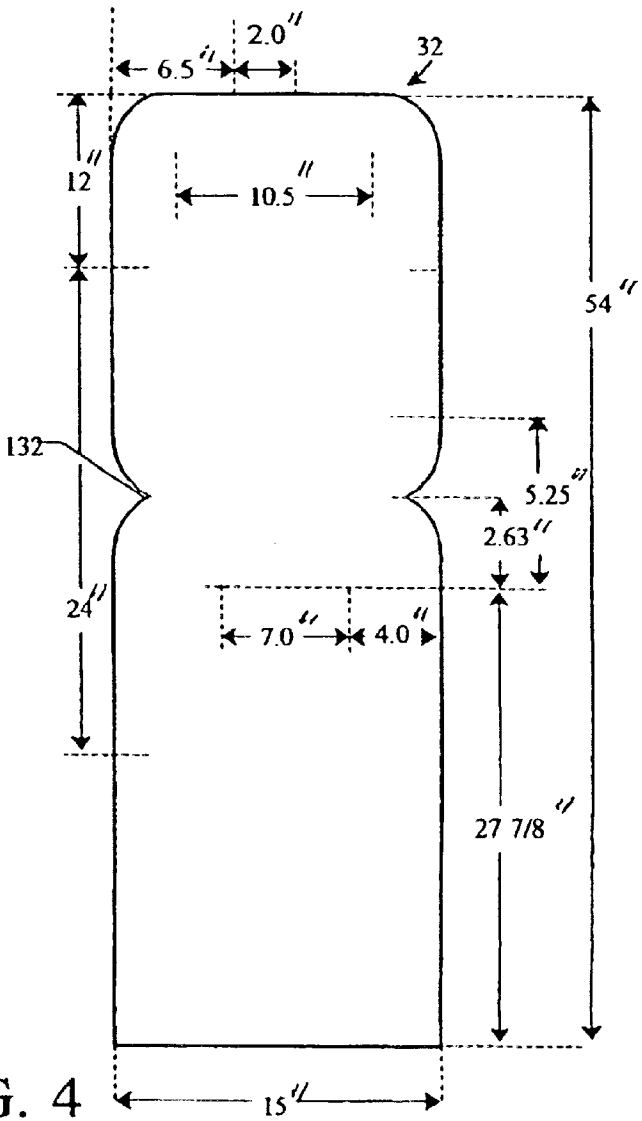
FIGS. 3–5 are pattern drawings of the three fabric panels 31–33 that are sewn together to form the cover 2 according to the present invention.
Figure 3:
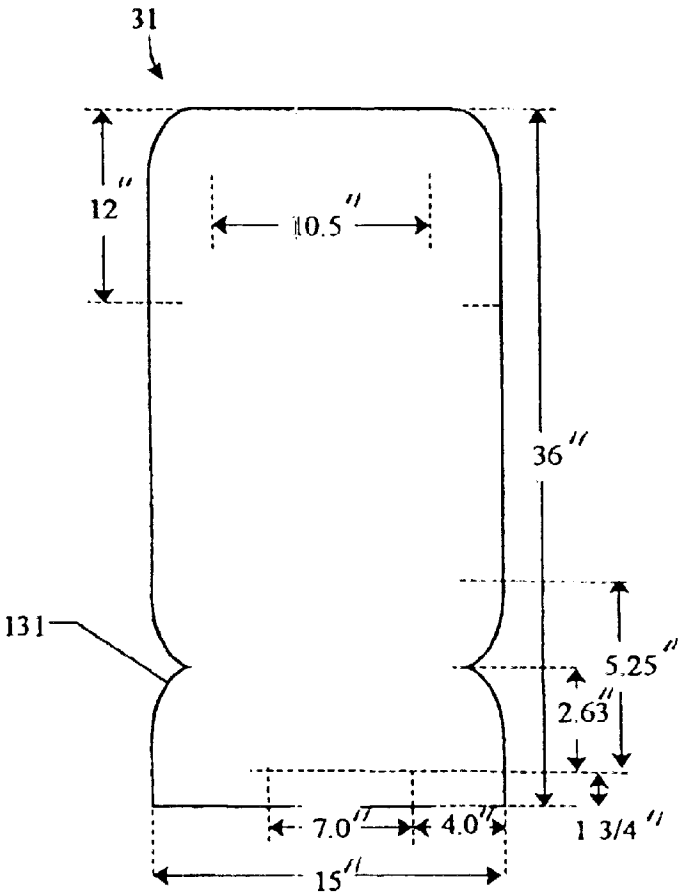
Figure 5:
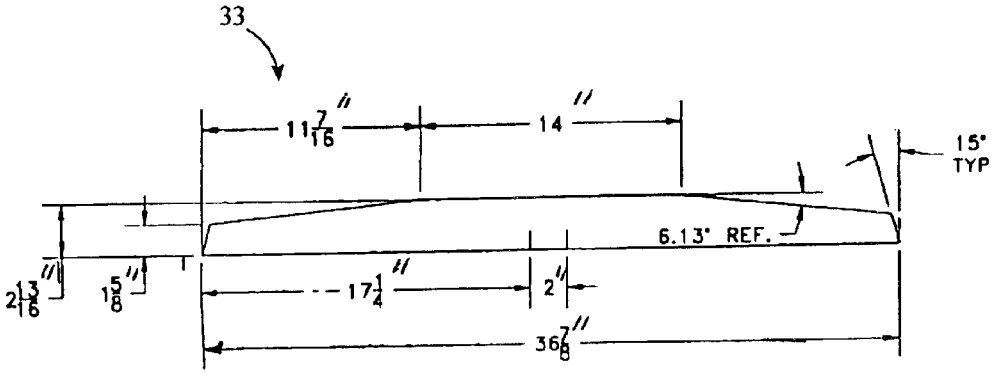

FIGS. 3–5 are pattern drawings showing the construction of the novel three-part cover 2 inclusive of three fabric panels 31–33 that are sewn together to form the cover 2 according to the present invention.

FIG. 3 is a front pattern view of the bottom panel 31. The bottom panel 31 is formed in a generally rectangular configuration with a small constriction 131 at one end. The dimensions of the major portion of bottom panel 31 are 15 in. across by 29 in. long. The dimensions of the smaller portion of the bottom paddle 31 (opposite constriction 131) is 15 in. across by 7 in. in length. The corners of the major portion of the bottom panel 131 are rounded as shown.

FIG. 4 is a front pattern view of the top panel 32. Top panel 32 is formed as two substantially rectangular portions integrally joined at constriction 132. The dimensions of the panel 32 are 15 in. across by 54 in. in length, with the constriction 132 occurring 30 ½ in. from the bottom edge.

FIG. 5 is a front pattern view of the side panel 33. Side panel 33 is a narrow strip of fabric with dimensions of 36 ⅞ inches long and 2 13⁄16 in. high at the midpoint. The corners of the side panel 33 are inclined inward as shown, and the upper edge of the side panel 33 is tapered as shown to yield the illustrated dimensions.

All three of panels 31–33 are preferably cut from cotton or, optionally, polyester (not corduroy, canvas or plastic as stated in U.S. Pat. No. 4,410,214 to Geschwender).

Figure 6:
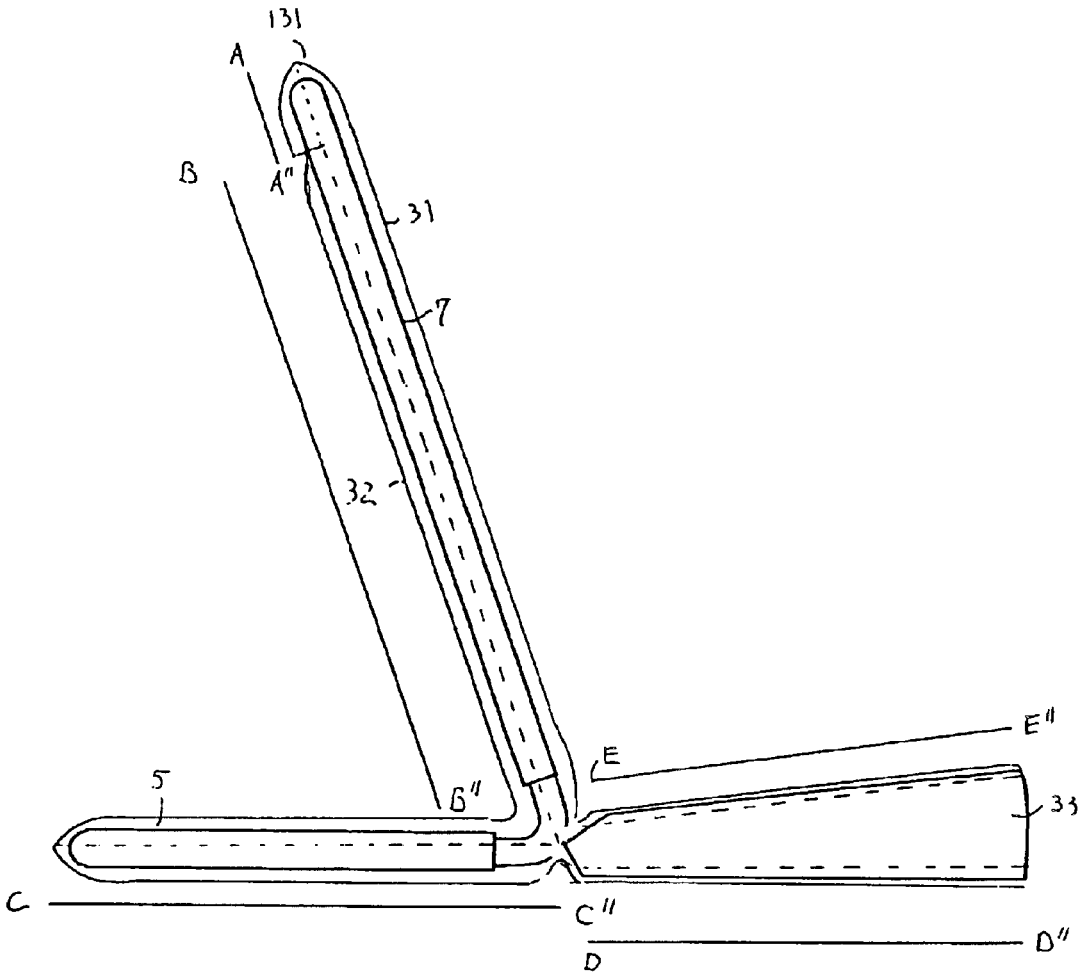
FIG. 6 is a sewing diagram illustrating how the three fabric panels 31–33 are sewn together to form the cover 2 according to the present invention.

The cover 2 is completed by sewing the three panels together as further illustrated in FIG. 6. With combined reference to FIGS. 3–6, the bottom panel 31 is doubled over at the small constriction 131 and this section is sewn together at the margins along line A–A" to form a pocket for covering the top of frame portion 7. This and all other sewing is accomplished by bringing the two sections together, sewing together around the margins thereof; and inverting to hide the seams. The rectangular end of the top panel 32 is tucked into the pocket of bottom panel 31, and the margins of the top panel 32 and bottom panel 31 are sewn together over approximately 24 inches as shown at line B–B". The remaining free extent of the bottom panel 31 is doubled over, and a portion is sewn together at the margins along lines C–C" to form a pocket for covering the lower frame portion 5. The remaining free extent of the bottom panel 31 is then sewn together at the margins to one side of the elongate side panel 33 as shown at line D–D", and the other side of the elongate side panel 33 is sewn to the remaining free extent of the top panel 32 along lines E–E". The elongate side panel 33 forms a wedge-shaped pocket between the top and bottom panel sections 30, 31, and this encloses the cushion there between. The wedge-shaped foam cushion is held captive inside the opposing panel sections by sewing the opposing panel sections together at their constriction.

Figure 7:
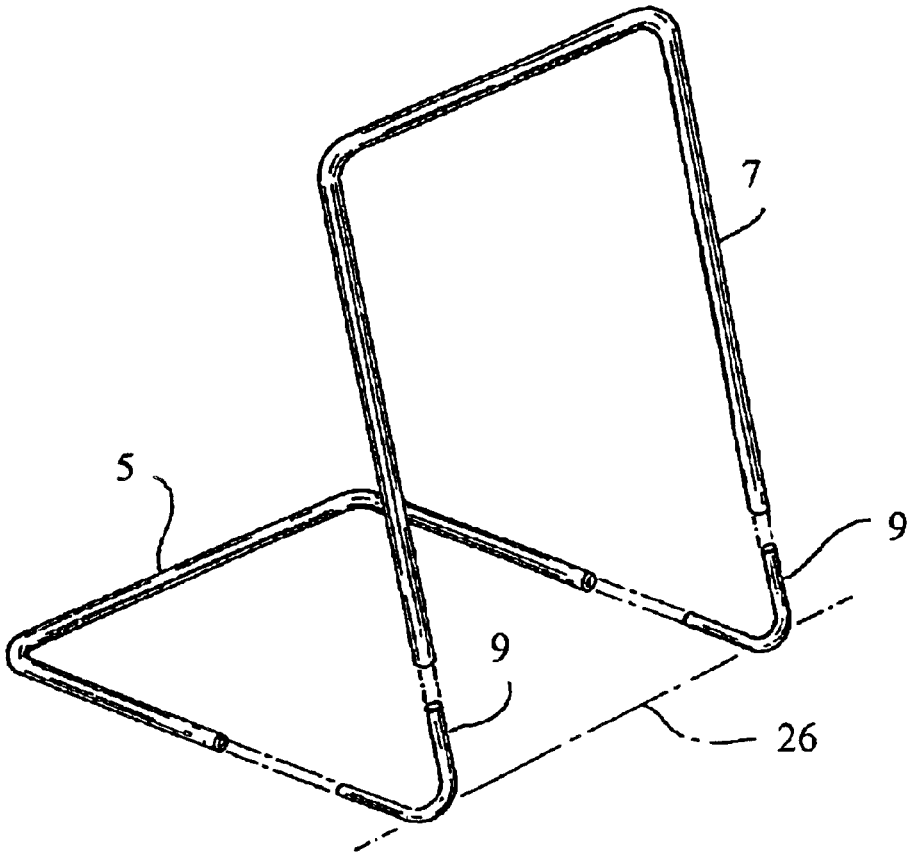
FIG. 7 is a side perspective illustration of the knock-down frame 4.

FIG. 7 is a side perspective illustration of the knock-down frame 4. Knock-down frame 4 generally includes a pair of U-shaped frame portions 5 and 7. Both of these frame portions are of round metallic tubing of substantially uniform diameter along the entire length. The tubes are preferably cold forged. A pair of generally L-shaped connectors 9 connect the ends of the frame portions 5, 7 to form a rigid L-shaped frame as viewed from the side. The connectors 9 are also cold forged elbows, and are fitted to be telescopically received in the ends of the tubular frame portions 5, 7. The included angle between the legs of each connector 9 is about 70–80°. In accordance with the present invention, the annular rim at both ends of both of the U-shaped frame portions 5 and 7 is outwardly chamfered or beveled.

In addition to chamfering, it has been found that Zinc-plating is a great benefit. The value of Zinc as a rust-proof finish for steel has long been known. This is because the zinc forms a continuous coating over the whole article. Specifically, Zinc creates a tenacious oxide skin. The rust proof qualities of the coating prolongs the life of the tubing. It has also been found that the Zinc skin is an excellent fabric lubricant for the cover. The Zinc plating eases assembly of the frame components as well as installation of the cover. Once the cover is on the Zinc lubricates around the joints to prevent tearing.

Figure 8:
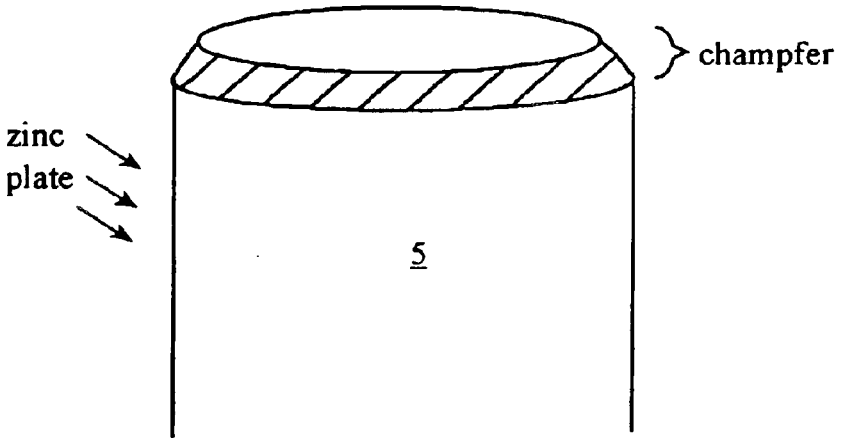
FIG. 8 illustrates a beveled joint of two inter-fitting frame members 34, 36 in accordance with the present invention.

FIG. 8 illustrates a Zinc-plated and chamfered end of an exemplary frame member 5 in accordance with the present invention. The chamfering is best accomplished by grinding the rim around its periphery. The chamfered ends of the U-shaped frame portions 5 and 7 greatly facilitates insertion of the cover 2 as will be described, and it reduces the risk of tearing of the fabric cover 2.

Figure 10:
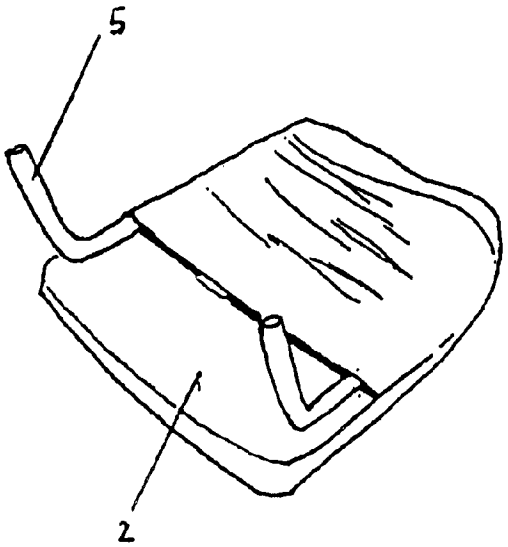
FIGS. 9–11 are perspective drawings showing the installation procedure for cover 2 onto frame 4.
Figure 9:
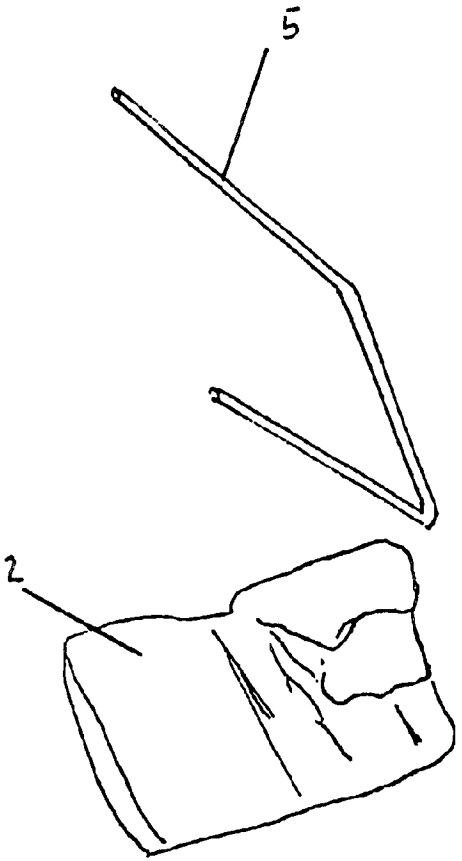
Figure 11:
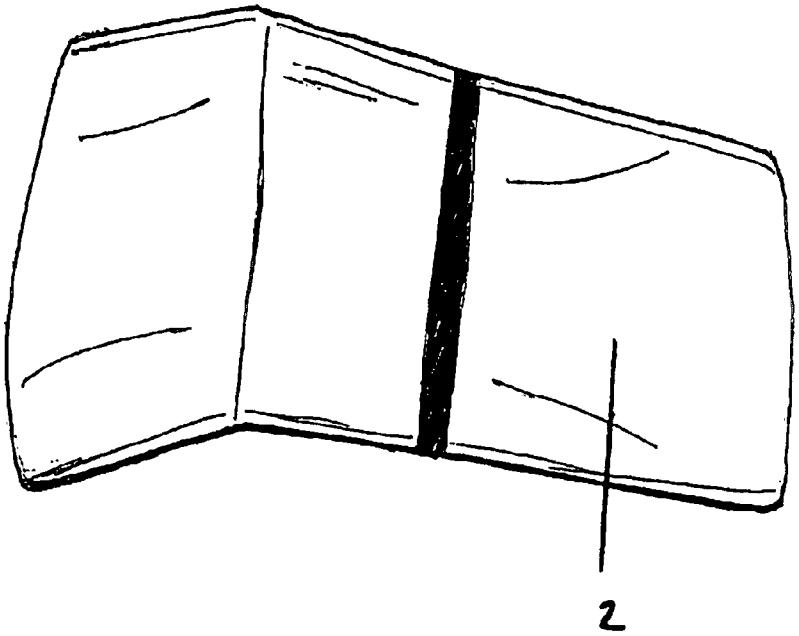

FIGS. 9–11 are perspective drawings showing the installation procedure for cover 2 onto frame 4. As shown in FIG. 9, the open end of cover 2 is inserted over the seat portion 5 of frame 4 (or the seat portion 5 is inserted into the cover).

As shown in FIG. 11, cover 2 is slid upward over the seat portion 5. The backrest portion 7 of frame 4 is installed and cover 2 is slid upward over backrest 7 until the entire frame 4 is completely enclosed.

Figure 12:
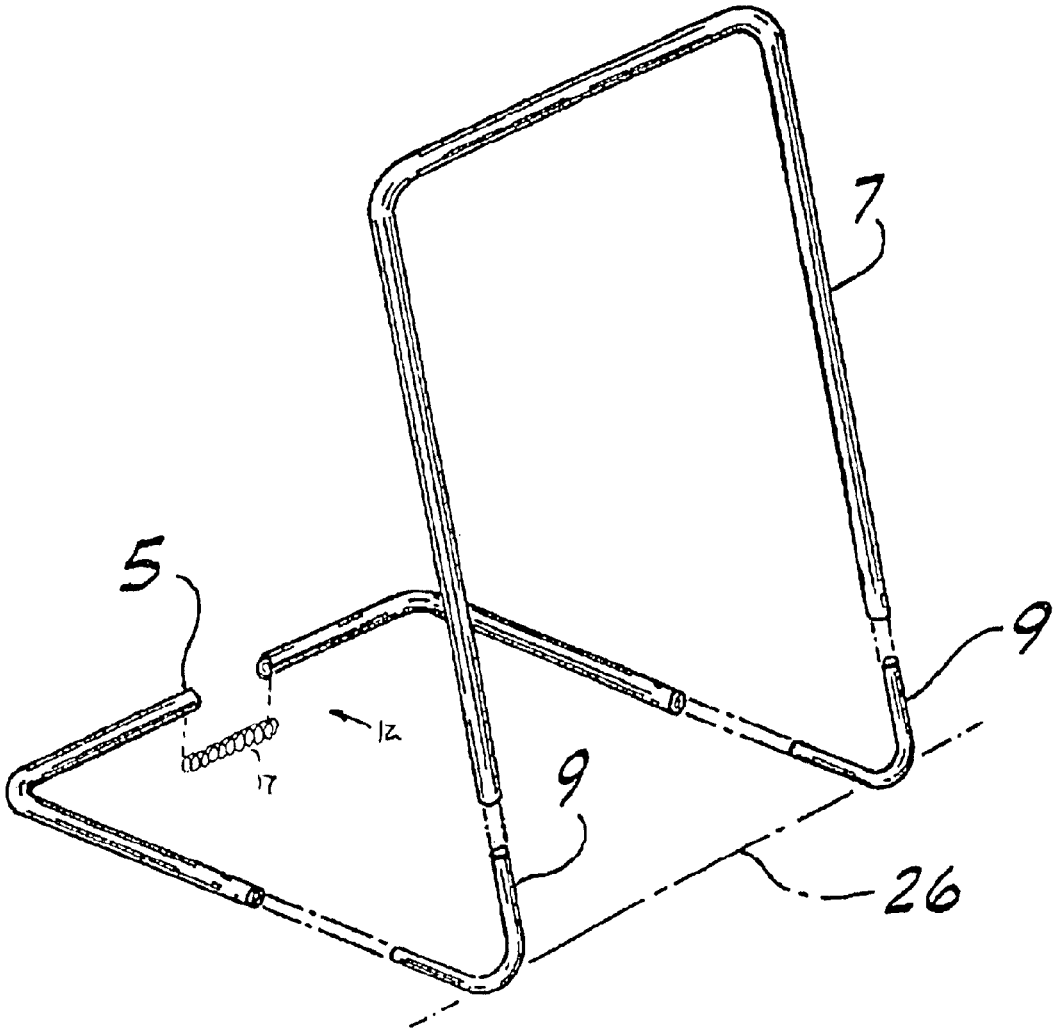
FIG. 12 is a perspective drawing of a spring-loaded break point in frame 4 for easier knock-down and assembly.

As shown in FIG. 12, the flap at the open end of cover 2 is then inverted over the end of the frame 2 to secure the cover 2 in place over the frame 4. The installation procedure for cover 2 is similar to that shown for the '214 patent to Geschwender. However, the present cover pattern in conjunction with the chamfered ends of the U-shaped frame portions 5 and 7 makes insertion of the cover 2 a simple matter. Once cover 2 is installed, the leisure chair may be used in one of two positions: 1) a "sitting" position wherein the seat portion of frame 4 rests flat on the floor and the backrest portion extends upwardly and rearwardly with the cushion portion of cover 2 extending forwardly from the frame 2 and resting on the floor; and 2) a "reclining" position in which the seat portion of the frame 4 extends up from the floor and the backrest portion slopes down from the support portion to the floor with the cover 2 presenting a reclining surface. The cushion is swung relative to the frame 4 so that it rests against the frame 4 to provide a headrest for one reclining on the chair.

It should be appreciated that the polyester fabric may be provided in a variety of different colors or ornamental patterns, and in view of the above-described form-fitting pattern, invariably results in an aesthetically pleasing product.

In addition to the features described above, the present invention also includes an optional spring-loaded break point at the bottom of the U-shaped frame portion 5 to allow the frame 4 to be disassembled and folded completely flat. It is noted that a spring-loaded break point can be incorporated in either one or both of the U-shaped frame portions 5, 7 to accomplish the purpose.

FIG. 12 is a perspective drawing of an exemplary spring-loaded break point 12 in frame portion 5 for easier knock-down and assembly. The spring-loaded break point 12 is accomplished by adding a non-telescoping joint midway along the frame portion 5. A spring 17 is chosen with an inner diameter that gives a secure compression fit over the ends of both frame portions 5*a* and 5*b*, and spring 17 is screwed onto the ends of both frame portions 5*a* and 5*b*. Given this configuration, the joint in frame portion 5 (and/or frame portion 7) can be broken and folded without actually physically separating the component parts. The spring 17 maintains the U-shaped frame portions intact.

Having now fully set forth the preferred embodiments and certain modifications of the concept underlying the present invention, various other embodiments as well as certain variations and modifications of the embodiments herein shown and described will obviously occur to those skilled in the art upon becoming familiar with said underlying concept. It is to be understood, therefore, that the invention may be practiced otherwise than as specifically set forth in the appended claims:

We claim:

1. An articulating chair, comprising:

a knockdown frame including a pair of separate generally U-shaped frame portions, one constituting a seat portion and the other constituting a backrest frame portion, each of said U-shaped frame portions having two chamfered ends, and a pair of generally L-shaped connectors adapted for a telescopic fit into the chamfered ends of said frame portions to form a rigid generally L-shaped frame, and all of said U-shaped frame portions and L-shaped connectors being Zinc plated for ease of assembly;

a removable cover formed to fit over the frame and to hold said knockdown frame in assembly, said cover including a top panel section sewn against a bottom panel section, a side panel section sewn there between, and a cushion enclosed there between, said cover being insertable over said frame and swingable relative to the frame;

whereby said chair may be assembled and positioned on a surface in one of a first position in which the seat portion of the frame rests flat with the backrest portion extending upward to provide a backrest, said cushion extending forwardly from the frame to provide a seat, and a second position said chair being adapted to be overturned from said first position to a second position in which the seat portion of the frame extends upwardly and the backrest portion slopes downwardly with the cushion resting thereon to present a reclining surface.

2. The articulating chair according to claim 1, wherein at least one of said generally U-shaped frame portions are provided with a spring-loaded joint.

3. The articulating chair according to claim 2 wherein said spring-loaded joint further comprises a bi-section in said frame portion and a spring having an inner diameter that gives a secure compression fit over the ends of the bisected frame portions.

4. The articulating chair according to claim 3, wherein said spring is screwed onto the ends of the bi-sected fame portions.

* * * * *